United States Patent [19]

Cooper

[11] 4,394,124

[45] Jul. 19, 1983

[54] FLOTATION LIFE SUPPORT DEVICE

[76] Inventor: Harold W. Cooper, 30 Ensley, Oxford, Mich. 48051

[21] Appl. No.: 265,040

[22] Filed: May 18, 1981

[51] Int. Cl.[3] ..... B63C 9/00

[52] U.S. Cl. ..... 441/86

[58] Field of Search ..... 441/80, 86, 87, 88, 441/81, 104, 113, 126, 129, 130, 131

[56] References Cited

U.S. PATENT DOCUMENTS

| | | | |
|---|---|---|---|
| 676,836 | 6/1901 | Brown | 441/86 |
| 1,129,108 | 2/1915 | McKelvy | 441/87 |
| 1,140,358 | 5/1915 | Cleave | 441/87 |
| 2,075,374 | 3/1937 | Tucker | 441/131 |
| 3,925,839 | 12/1975 | Smith | 441/104 |
| 3,986,220 | 10/1976 | Johnson | 441/86 |

*Primary Examiner*—Trygve M. Blix
*Assistant Examiner*—Jesus D. Sotelo
*Attorney, Agent, or Firm*—Fisher, Gerhardt, Crampton & Groh

[57] ABSTRACT

A flotation life support device in which a buoyant ring is hinged to form an opening permitting entry of an occupant and in which an underwater bag depends from the ring and has an opening in alignment with the opening in the ring permitting easy entry to the ring and bag. The opening in the bag is closed by a slide fastener so that the occupant and the water contained in the bag are separated from the surrounding water to minimize dissipation of body heat. The ring also is provided with a seat to support the occupant and with a canopy to protect the occupant against spray and wave action for easier control of breathing.

8 Claims, 5 Drawing Figures

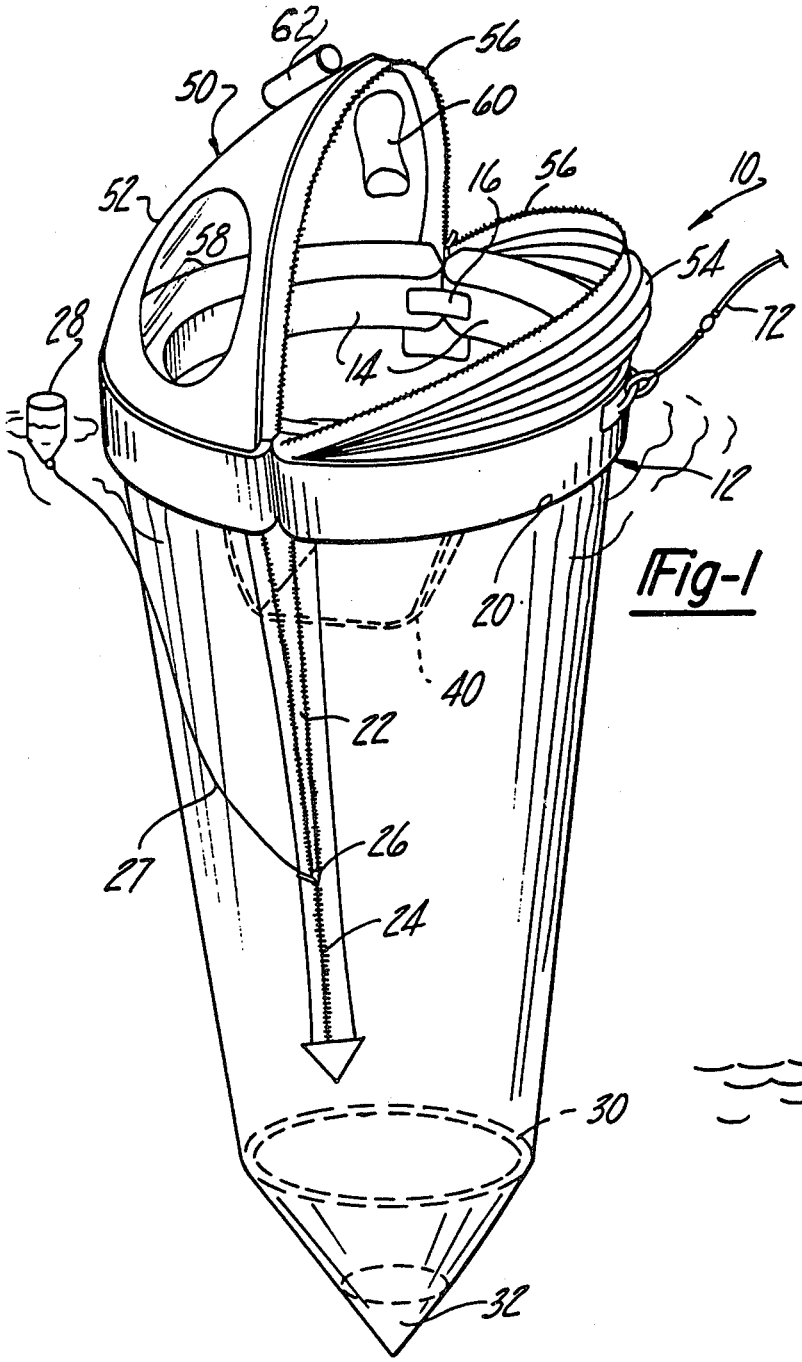
Fig-1
Fig-3
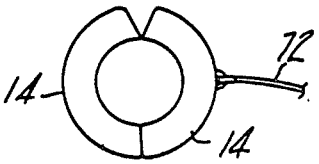
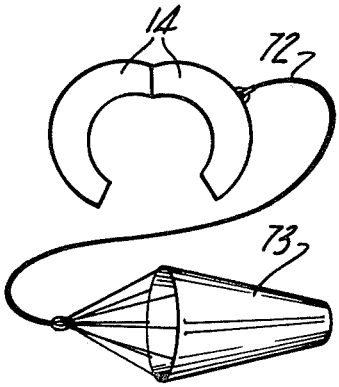
Fig-4
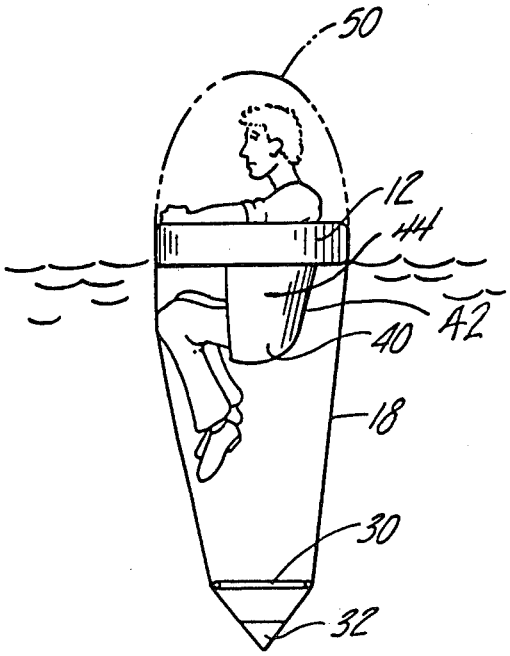
Fig-2
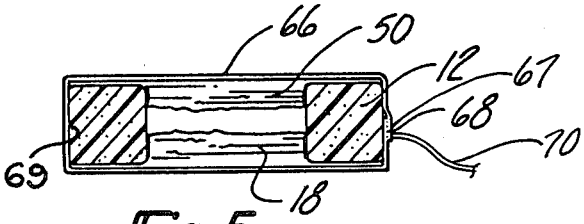
Fig-5

FLOTATION LIFE SUPPORT DEVICE

This invention relates to flotation type life support devices for use in water by an individual and more particularly to devices of a type frequently referred to as life rings or life saving apparatus carried on vessels.

Many vessels, particularly racing yachts carry a variety of safety devices intended to be used in the event that someone falls overboard to supplement flotation of the individual and facilitate location during subsequent rescue operations. One of such devices is in the form of a life ring and it is the usual instructions and procedure to immediately throw a life ring into the water in the event that anyone falls overboard with the expectation that such a ring will be of further assistance to maintain flotation in addition to any personal flotation gear or jacket that the individual may be wearing. In addition to the need for flotation, however, it is necessary that the person who falls overboard be protected against hypothermia in the event that the rescue operations take longer than normal. Studies have shown that the loss of body heat in cold waters lead to extremely short periods of survival. Additionally it is desirable that the individual be protected against the problems of controlled breathing in the event that wave action is violent and that the individual be protected from sharks which are often attracted by body movement and fluid discharge. Additionally it is important that the flotation device facilitates location during the rescue operations.

It is an object of the invention to provide a flotation type life support device which will support an individual to limit body heat loss.

Still another object of the invention is to provide a flotation type life support device which will protect the user from shark attack.

Yet another object of the invention is to provide a life support device facilitating control of breathing during violent wave action.

The objects of the invention are accomplished by providing a flotation type life support device in which a ring member is hinged at one circumferential point to provide opening of the ring at a diametrically opposed point. The ring is provided with a flexible fabric bag adapted to depend from the ring when the latter is in a floating position with the bag having an open end attached to the periphery of the ring. The bag also is provided with an elongated opening in one side of the bag which is in alignment with the opening of the ring so that when the ring and bag are in their open position entry to occupy the ring is facilitated. A flexible seat member also is provided to depend from the ring so that an occupant may allow his body to be completely supported from the ring in a seated position. A canopy also is provided which is made of flexible material and which may be closed over the top of the ring to prevent entry of spray and waves to permit the occupant to more easily control breathing.

The preferred embodiment of the invention is disclosed in the drawings in which:

FIG. 1 is a perspective view showing the flotation type life support device embodying the invention.

FIG. 2 is a diagrammatic view at a reduced scale showing the life support device occupied and in use in the water;

FIG. 3 is a top view of a portion of the life support device at a reduced scale;

FIG. 4 is a view similar to FIG. 3 showing another condition of operation of the life support ring; and FIG. 5 is a cross-sectional view at a slightly enlarged scale of the life support in its packed or storage condition prior to being thrown into the water for use.

The flotation life support device embodying the invention is designated generally at 10 and includes a buoyant ring 12 which includes a pair of semicircular elements 14 joined together by a flexible hinge 16. The semicircular elements 14 are preferably fabric covered flotation material which offers limited resiliency and a relatively firm supporting and floating structure which forms the base for the life support device 10.

A bag 18 depends from the ring 12 when the latter is in a floating position in the water. The bag 18 is slightly larger at its open upper end and has an edge 20 attached to the periphery of the ring 12. The bag 18 has an elongated opening 22 which extends from the upper edge 20 of the bag 18 for a substantial portion of the bag. The opening 22 is provided with a slide closure or zipper 24 which is closed by a slide 26 upon movement from a lower position to an upper position on the bag 18. The slide 26 is attached to a lanyard 27 having a small float 28 at its opposite end.

The opening 22 in bag 18 is in alignment with and a continuation of an opening 29 between the semicircular elements 14 hinged at 16 to their open position as illustrated in FIG. 4.

The lower end of the bag 18 is provided with a ring 30 which facilitates keeping the bag in an open position and the lower-most portion of the bag 18 is provided with a weight or ballast 32 which assists deployment of the device 10 and maintains the bag 18 in a depending position from the ring 12 when the latter is in the floating condition.

Preferably the bag 18 is black or of a dark color which studies have shown are the least likely to attract sharks.

The ring 12 also is provided with a depending collapsible seat 40. The seat 40 preferably is made of a closed foam material which it has been found resists the transfer of heat and when in contact with the seat and bag of the user, assists in reducing the dissipation of heat from the body. The seat 40 has a back portion 42 a portion of which is attached together with side panels 44 to an underside of each ring portion 14 adjacent the hinge 16.

The upper surface of the ring 12 is fitted with a canopy 50 which as illustrated in FIG. 1 has separate portions 52 and 54 attached to the semicircular element 14 forming the ring 12. The portions 52 and 54 are joined together by a slide closure or zipper 56. The portions 52 and 54 can be provided with transparent, flexible ports 58 to offer visibility for an occupant of the ring 12. Also, the canopy portions 52 and 54 are provided with ventilator pockets 60 which permit the entry of air but resist the direct entry of spray and water. The canopy 50 preferably is made of a highly visible color to facilitate location of the device and its occupant during rescue operations. Also, the top of the canopy can be provided with a personal rescue light 62.

Pockets, not shown, can be provided on the ring 12 for the purpose of storing die marker material and signal flares which an occupant can use to assist in his own rescue operations.

On board a yacht the flotation life support device is stored in its collapsed condition as viewed in FIG. 5. In that condition, the bag 18 has its slide closure 24 at its fully open position, that is with the slide 26 at the lower end of the closure as viewed in FIG. 1. Also, the canopy 50 is folded with the closure 56 in its fully open position. Both the bag 18 and canopy 50 are held in their collapsed and folded position by a strap 66 having abutting ends connected together by hook and eye material 68 available under the trademark VELCRO. An intermediate point 69 on the strap 66 is connected to the ring 12 and the tab 67 is provided with a lanyard or line 70 attached at an intermediate point on the strap 66 and has its opposite end connected to the vessel. When the device 10 is thrown overboard, the lanyard 70 pulls the VELCRO fastener 68 from the strap 66 so that the device 10 can be deployed in the water.

It is common practice to provide life ring devices with drogues and in the present case provision is made for attachment of a line 72 to one of the semicircular elements 14 at a point spaced from the flexible hinge 16. The purpose of the drogue 73 is to prevent the device 10 from being blown by the wind on the surface of the water and to maintain the device 10 in as stable a position as is possible. In the present instance, the pull of the drogue 73 on the line 72 tends to open the semicircular elements 14 to the position illustrated in FIG. 4 and also holds the opening 22 in the bag 18 in the opened position for more easy entrance by a user. Once the ring is entered, the slide 26 on the closure 24 of the bag opening 22 can be moved upwardly to a closed position through means of the lanyard 27 which is made available to the occupant of the ring by means of the float 28. This makes it possible for the user of the device 10 to close the opening 22 without requiring submerging by simply grasping the float 28 and pulling upwardly.

With the ring 12 and bag 18 closed and occupied, the bag 18 will be filled with water but the bag will remain in the relatively depending position due to the weight 32. The occupant may use the seat 40 to reduce the weight on the upper arms and shoulders or if he prefers he can stand in the bag 18. The closed bag 18 will contain water and resist the transfer of water from the bag to the surrounding waters so that body heat lost to the water in the bag is not easily transferred to the surrounding waters. Similarly, body fluids which might attract sharks are contained within the bag to resist attraction of sharks. If wave action is such that breathing must be controlled, the canopy can be closed by using the slide closure 56 so that the occupant can be in a relatively closed envelope as illustrated diagrammatically in FIG. 2.

A flotation life support device has been provided in which a buoyant ring is hinged at one circumferential point to form an opening at its diametrically opposed point which is in alignment with an opening in a depending bag. The opening in the bag as well as the ring, can be closed by a slide fastener after the ring and bag are occupied so that the water in the bag is not easily transferred to the surrounding waters thereby containing as much as possible lost body heat to reduce the effects of hypothermia. Similarly, the seat is provided not only to assist in supporting the body relative to the ring, but is formed of a material resisting loss of body heat by those portions of the body contacted by the seat bottom, sides and back. The support device is also provided with a canopy which can be closed to protect the occupant against wave action to facilitate easier control of breathing. The submerged portions of the device, namely the bag, are made of a color least attractive to sharks and the exposed portions of the device are of a color facilitating location during rescue operations.

The embodiments of the invention in which an exclusive property or privilege is claimed are defined as follows:

1. A flotation life support device comprising: a buoyant ring member hinged at one circumferential point and forming an opening at a diametrically opposed point, a bag adapted to depend from said ring member when the latter is in a floating position, said bag having an open end attached to the periphery of said ring member, an opening formed in one side of said bag and being provided with a slide closure, said opening being in alignment with said opening in said ring member, a flexible seat member supported from said ring member within said bag for supporting an occupant, a canopy made of flexible material attached to the periphery at the upper side of said ring member, a slide fastener dividing said canopy into two portions extending from said hinge to said opening and being closable to enclose said ring member and the open end of said bag, said slide fastener closing the opening in said bag being in its most open position when the fastener is at a lower end of said opening, and a lanyard having one end attached to said slide fastener and having the other end provided with a flotation element.

2. A flotation life support device comprising: a buoyant ring member hinged at one circumferential point and forming an opening at a diametrically opposed point, a bag adapted to depend from said ring member when the latter is in a floating position, said bag having an open end attached to the periphery of said ring member, an opening formed in one side of said bag and being provided with a slide closure, said opening being in alignment with said opening in said ring member, a flexible seat member supported from said ring member within said bag for supporting an occupant, a canopy made of flexible material attached to the periphery at the upper side of said ring member, a slide fastener dividing said canopy into two portions extending from said hinge to said opening and being closable to enclose said ring member and the open end of said bag, and a drogue attached by way of a flexible line extending between said drogue and a point on said ring member tending to hinge said ring member to an open position.

3. The life support structure of claim 2 wherein said bag is formed of a flexible dark material to minimize attraction of sharks.

4. The life support structure of claim 2 wherein said canopy is formed of a light reflective material to facilitate observation.

5. The life support structure of claim 2 wherein said seat member is formed of an insulated material resisting dissipation of heat.

6. The life support structure of claim 2 and further comprising ballast in the bottom of said bag to maintain said bag in a depending position when said ring member is in the floating position.

7. The life support structure of claim 2 wherein said bag and said canopy are foldable into a storage relationship relative to said ring member.

8. A flotation life support device comprising: a buoyant ring member including a pair of semi-circular float members hinged together at adjacent ends of said float members and forming an opening at the opposite adjacent ends of said float members, a bag having an open upper end connected to said ring member and depending therefrom when said ring member is in a floating position, said bag having an elongated opening in one side in alignment with and forming a continuation of the opening between said semi-circular float members, a slide closure including a slide element for closing said elongated opening, said slide element being moveable upwardly from an open position to a closed position, a ballast element in the bottom of said bag to maintain said bag in a depending position relative to said ring member, a flexible seat member having opposite sides supported from said float members and within said bag for supporting an occupant, a canopy made of flexible material attached to the upper side of said ring member, said canopy having an opening in alignment with and forming a continuation of the opening between said semi-circular members, and means closing the opening in said canopy to enclose said ring member and said seat member within said bag, and a float attached by a line to said slide element to facilitate access thereto.

* * * * *